United States Patent [19]

Eley

[11] 4,138,602

[45] Feb. 6, 1979

[54] OVER-CENTER TOGGLE SWITCH

[75] Inventor: Edgar R. Eley, Athens, Ga.

[73] Assignee: Westinghouse Electric Corp., Pittsburgh, Pa.

[21] Appl. No.: 847,182

[22] Filed: Oct. 31, 1977

[51] Int. Cl.[2] ..... H01H 21/04

[52] U.S. Cl. ..... 200/67 R; 200/18; 200/70; 200/153 G; 200/DIG. 42; 74/97

[58] Field of Search ..... 200/48 R, 67 R, 67 C, 200/67 PK, 70, 153 G, 153 SC, 11 TC, 18, 50 C, DIG. 42; 74/97

[56] References Cited

U.S. PATENT DOCUMENTS

| | | | |
|---|---|---|---|
| 761,743 | 6/1904 | Wright | 200/48 R |
| 1,793,284 | 2/1931 | Greenewalt | 200/18 |
| 2,468,463 | 4/1949 | Rowe | 74/97 |
| 2,494,314 | 1/1950 | Rowe | 74/97 |
| 2,625,619 | 1/1953 | Rigert | 200/70 X |
| 2,668,449 | 2/1954 | Dunshee | 200/70 X |
| 2,995,043 | 8/1961 | Lusk et al. | 74/97 |
| 3,064,484 | 11/1962 | Alsaker | 74/97 |
| 3,164,693 | 1/1965 | Nicholas et al. | 200/48 R |
| 3,211,870 | 10/1965 | Lusk et al. | 74/97 X |
| 3,484,570 | 12/1969 | Perkins et al. | 200/48 R |
| 3,590,183 | 6/1971 | Leonard | 200/70 X |
| 3,624,319 | 11/1971 | Ristuccia | 200/11 TC |
| 3,790,731 | 2/1974 | Date | 200/153 SC |

*Primary Examiner*—Herbert F. Ross
*Attorney, Agent, or Firm*—D. R. Lackey

[57] ABSTRACT

An over-center toggle switch suitable for use in an electrical distribution transformer as a series-multiple switch or as a no-load tap changer switch. The over-center toggle switch imparts snap action rotation to a movable contact assembly and, further, cams the movable contact assembly immediately prior to the snap action movement thereby causing an initial rotation of the movable contact assembly. In multiple phase distribution transformers, individual over-center toggle switches are associated with each phase and are interconnected by suitable connecting means to an operating mechanism whereby rotation of the operating mechanism through a predetermined angle causes independent operation of each over-center toggle switch which thereby imparts camming and snap action rotation to the movable contact assemblies in each phase of the distribution transformer.

6 Claims, 7 Drawing Figures

OVER-CENTER TOGGLE SWITCH

BACKGROUND OF THE INVENTION

1. Field of the Invention

This invention relates in general to over-center toggle switches and, more specifically, to an over-center toggle switch which is adapted to be disposed within the casing of an electrical distribution type transformer.

2. Description of the Prior Art

Many distribution transformers are purchased by electrical utilities with series-multiple switches, which are externally operable no-load switches disposed within the transformer tank and connected to certain winding or coil sections of the transformer which are connected either in series or in parallel by the switch. Thus, the electrical utility is free to change the magnitude of the voltage applied to the distribution transformers in the future, without the necessity of changing all of the distribution transformers connected to the system. Since the series-multiple switch is operated only at the time of a system voltage changeover, it is a no-load type switch and although it does not have to be constructed to allow a large number of mechanical operations, it must be extremely reliable. A common type of switch that has been widely used in industry and one that is espcially suited for use as a series-multiple switch in distribution transformers is a so-called over-center toggle switch. The over-center toggle switch, as depicted in U.S. Pat. Nos. 2,995,043, 3,164,693, 3,484,570 and 3,590,183, has advantageously been used in electrical applications to provide quick make and break action between the movable and stationary electrical contacts of an electrical apparatus which insures both a positive opening force and good electrical engagement between the movable and stationary contacts.

In applications wherein welding between the movable and stationary contacts poses a problem or where there is considerable frictional engagement between the contacts, it is common to add additional components to the over-center toggle switch in order to provide additional opening and closing force to the contacts. These additional components include cams, as shown in U.S. Pat. Nos. 3,164,693 and 3,484,570, which interact with the drive and driven members of the over-center toggle switch to impart an initial rotation of the movable contacts immediately prior to the toggle release or, as shown in U.S. Pat. No. 3,590,183, may include pivot actuators or kickers which apply additional force to the movable contact assembly in order to insure a positive opening and closing action. Although the cams or kickers described above satisfactorily assist the toggle switch in rotating the movable contacts for breaking an electrical circuit, they necessarily involve additional components that must be added to the over-center toggle switch which increases the size, weight and complexity of the over-center toggle switch.

Thus, it would be desirable to provide an improved over-center toggle switch which will not only provide a fast opening and closing movement, but additionally, will provide a positive opening and closing action even if the contacts have considerable frictional engagement therebetween or are welded together. It would also be desirable to provide an over-center toggle switch which will incorporate a cam to produce initial movement of the movable contacts immediately in advance of the action of the toggle device and thereby assist the toggle device in rotating the movable contacts for breaking the electrical circuit. It would also be desirable to provide an over-center toggle switch which provides the aforementioned features with a simplified construction that involves fewer individual components than commonly required in prior art over-center toggle switches.

In multiple phase distribution transformer applications, it is necessary to insure that the movable contacts in each phase are connected to the proper stationary contact of each phase at the same time. The typical prior art method for utilizing over-center toggle switches in multiple phase applications is shown in U.S. Pat. No. 3,590,183 and includes a single over-center toggle switch mechanism which is connected by a common shaft to the movable contact assemblies in each phase of the distribution transformer. Thus, operation of the over-center toggle switch results in a simultaneous rotation of the movable contacts in each phase of the apparatus. In such a construction, it is difficult to insure that all of the movable contacts in each phase are in the same position at the same time. Close control of manufacturing tolerances is required for aligning the stationary contacts in each phase of the distribution transformer for identical movement of the movable contact assemblies therebetween. Such stationary contacts are necessarily designed oversized to allow for misalignment and the inherent backlash or tolerances in the movement of the movable contact assemblies which therefore results in a large toggle switch assembly which increases the tank size and the overall weight and cost of the electrical distribution transformer. Thus, it would be desirable to provide an improved over-center toggle switch which is easily ganged together with additional switches for use in multiple phase distribution transformers and, at the same time, insures that the switches are simultaneously in the same position in all phases of the electrical apparatus.

SUMMARY OF THE INVENTION

Herein disclosed is a new and improved over-center toggle switch suitable for use as a series-multiple switch or as a no-load tap changer switch in an electrical distribution type transformer. The over-center toggle switch includes a drive member which is journaled to a rotatable operating shaft and a driven member which is journaled to a rotatable actuating shaft disposed parallel to the operating shaft. A movable contact assembly is secured to the actuating shaft and rotatable therewith and is adapted for engaging a plurality of stationary electrical contacts disposed in an arcuate pattern in the plane of rotation of the movable contact assembly. The over-center toggle switch further includes a coil spring having one end abutting the drive member and another end connected by a concentrically disposed spring retainer rod to a flange on the driven member. The drive and driven members interact along with the spring and spring retainer rod such that rotation of the operating shaft and the drive member through a predetermined angle compresses the spring until the spring retainer rod is disposed past or over the center of a line extending through the center of the actuating shaft and the center of the flange of the driven member at which time the compressive spring energy is released resulting in a rapid snap action rotation of the driven member, actuating shaft and movable contact assembly which drives the movable contact assembly out of engagement with one stationary contact and into engagment with another stationary contact.

The drive member also includes an integral cam surface which engages the flange of the driven member when the drive member was rotated a predetermined amount and causes an initial rotation of the driven member, actuating shaft and movable contacts; which initial rotation is immediately prior to the snap action rotation caused by the release of the compressive spring energy as described above. This initial rotation insures a positive opening force that overcomes the strong frictional engagement of any weld occurring between the movable and stationary contacts.

The aforementioned over-center toggle switch provides quick opening and closing action that insures a good electrical connection between the movable and stationary contacts. In addition, by initially rotating the movable contacts in advance of the spring caused snap action rotation, the over-center toggle switch of this invention insures a positive opening of the contacts even if the contacts have considerable frictional engagement or are welded together. In addition, the over-center toggle switch provides the above features with fewer components than similar prior art type over-center toggle switches thereby minimizing the manufacturing cost and complexity of the switch and resulting in a small compact assembly.

The novel over-center toggle switch described above may also be easily ganged together for use in multiple phase distribution transformers. In multiple phase applications, individual over-center toggle switches are associated with each phase of the distribution transformer and include a pulley, journaled to the operating shaft of each switch, which is connected by suitable connecting means, such as cable, to an operating mechanism having a handle extending through the tank wall of the distribution transformer. Rotation of the operating mechanism through the predetermined angle causes the over-center toggle switch associated with each phase of the distribution transformer to operate in the manner described above wherein each switch provides snap action rotation of the movable contact assembly between adjoining stationary contacts independent from the operation of the other over-center toggle switches. This simplifies construction of the switch assembly since the stationary contacts in each phase need be aligned only with their respective movable contact assemblies, thus overcoming the difficult alignment procedures required with prior art type multiple phase series-multiple switches wherein the movable contacts in each phase thereof are driven by a single switch mechanism. Since the movement of the movable contact assembly associated with each over-center toggle switch is more accurate, the stationary contact structures may be made smaller, thereby reducing the overall size of the multiple phase switch assembly which provides a reduction in size and weight of the electrical distribution transformer.

BRIEF DESCRIPTION OF THE DRAWINGS

The various features, advantages and other uses of this invention will become more apparent by referring to the following detail description and drawing in which.

DESCRIPTION OF THE PREFERRED EMBODIMENT

Figure 1:
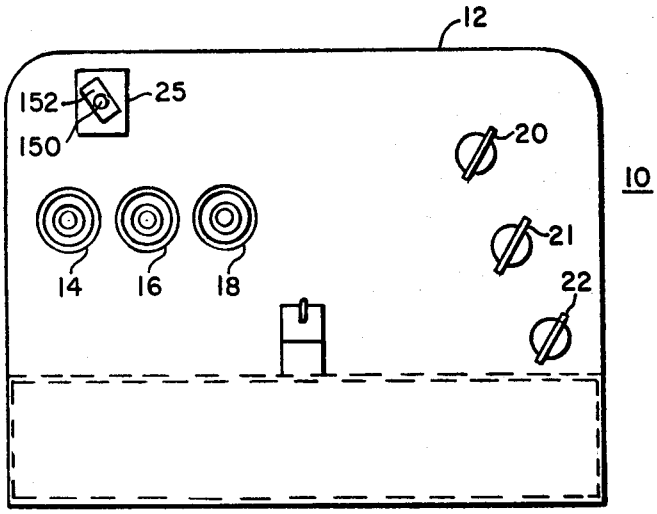
FIG. 1 is an elevational view of an electrical distribution type transformer which may utilize the teachings of this invention.

Throughout the following discussion, identical reference numbers are used to refer to the same component in all figures of the drawing.

With reference to the drawing, and to FIG. 1 in particular, there is shown an electrical inductive apparatus 10, such as a pad mounted electrical distribution type transformer. The transformer 10 includes a tank 12, shown with the terminal cover removed, which encloses a three-phase magnetic core and electrical winding assembly, not shown. The electrical winding assembly includes high voltage and low voltage windings which are connected to an external electrical distribution system via high voltage bushings 14, 16 and 18 and low voltage bushings 20, 21 and 22, respectively, which extend through the front wall of the tank 12. Furthermore, either or both of the low and high voltage windings may consist of many winding or coil sections which are connected in series, or in parallel, by a series-multiple switch; thus enabling the electrical utility to change the magnitude of the voltage applied to the distribution transformer 10 without the necessity of changing all the distribution transformers connected to the electrical distribution system. The series-multiple switch is an externally operable no-load switch which is disposed within the transformer tank 12 and connected to certain of the winding or coil sections of the transformers and actuated by an operating mechanism 25 which extends through the front wall of the tank 12 in sealed relationship. Although a three-phase series-multiple switch assembly containing individual switch assemblies is illustrated and described hereafter, it is to be expressly understood that a series-multiple switch may be constructed according to the teachings of this invention for use in single-phase transformer applications as well.

Figure 3:
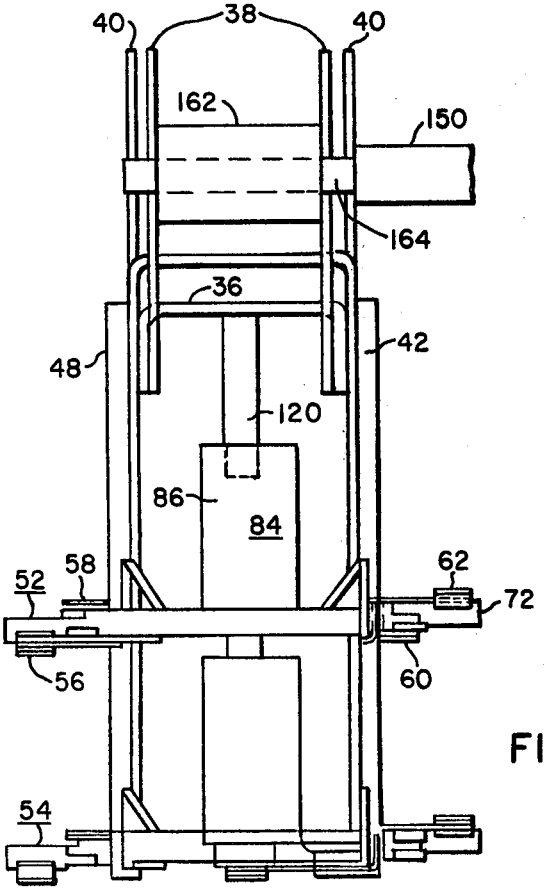
FIG. 3 is a left-hand end view of the switch assembly shown in FIG. 2.
Figure 2:
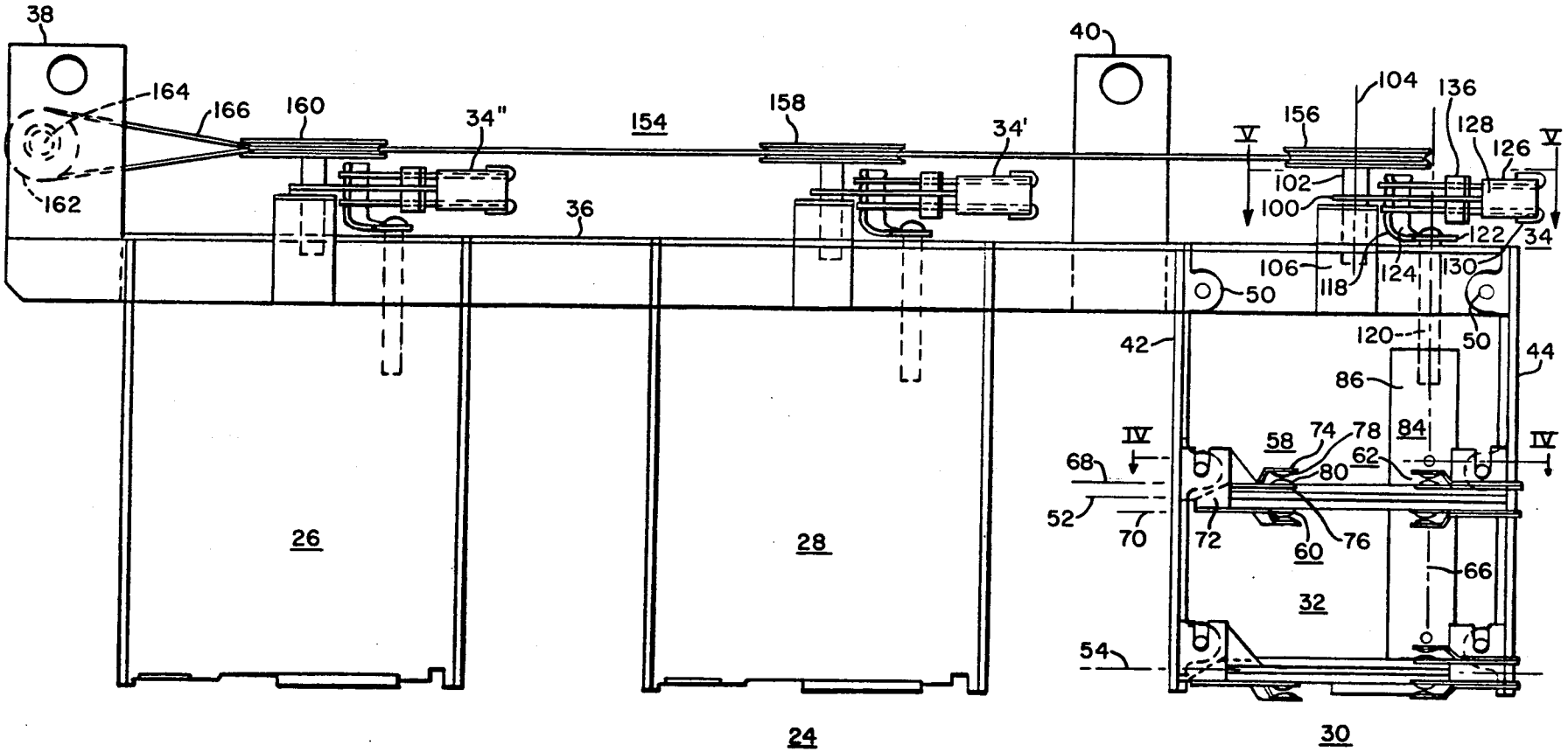
FIG. 2 is an elevational view of a three-phase switch assembly, each phase of which includes an over-center toggle switch constructed according to the teachings of this invention.

Referring now to FIGS. 2 and 3, there is shown a switch assembly 24 for use in the three-phase distribution transformer 10 which includes individual series-multiple switches 26, 28 and 30, each associated with one phase of the distribution transformer 10. The three-phase series-multiple switch assembly 24 includes suitable support structure whereon the individual series-multiple switches 26, 28 and 30 are mounted in an in-line configuration. The support structure includes a horizontally extending channel member 36 which has a pair of vertically extending brackets 38 and 40 secured thereto to provide suitable means for mounting the switch assembly 24 to mounting pads on the wall of the tank 12. Each series-multiple switch assembly 26, 28 and 30 includes a plurality of support posts, such as support posts 42, 44, 46 and 48 associated with series-multiple switch 30. Each support post is secured at its upper end to the channel member 36 by a suitable means, such as the bolts 50 shown in FIG. 2.

As the detailed construction of each of the series-multiple switches 26, 28 and 30 are identical, only series-multiple switch 30 will be described in detail hereafter. Accordingly, series-multiple switch 30 includes a contact assembly 32 and an over-center toggle switch mechanism 34. By way of example and not of limitation, the contact assembly 32 of the series-multiple switch 30 is divided into first and second decks 52 and 54, respectively, which enables many individual winding sections to be connected to any desired configuration by the electrical utility. Since the construction of the first and second decks 52 and 54 of the contact assembly 32 are identical, only the structure of the first deck 52 will be described hereafter. As shown in greater detail in FIG. 4, the first deck 52 of the contact assembly 32 includes a plurality of stationary contacts 56, 58, 60, 62 and 64 which are arranged in an arcuate pattern around a centerline or vertically extending axis 66. According to the preferred embodiment of this invention, the stationary contacts 56, 58, 60, 62 and 64 are arranged in two parallel planes 68 and 70, as shown in FIG. 2, with stationary contacts 58 and 62 disposed in the first plane 68 and contacts 56, 60 and 64 situated in the second or lower plane 70. The alternating of the stationary contacts between parallel planes enables a larger number of stationary contacts to be provided in a smaller space than would be possible if all the stationary contacts were arranged in a common plane. The stationary contacts 56, 58, 60, 62 and 64 are secured to a contact base assembly 72 which in turn is secured by suitable means, such as bolts, to the support posts 42, 44, 46 and 48 thereby rigidly connecting the contact assembly 32 to the support structure 36 of the three-phase series-multiple switch assembly 24.

Figure 4:
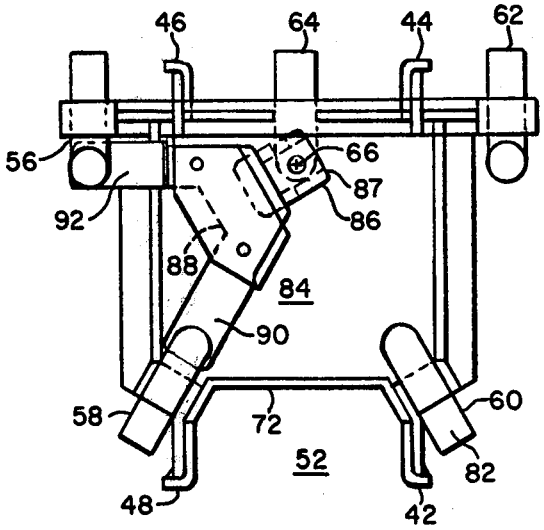
FIG. 4 is a sectional view, generally taken along line IV—IV in FIG. 2, showing the electrical contact assembly.

Each stationary contact, such as stationary contact 58 shown in FIGS. 2 and 4, consists of first and second fingers, such as fingers 74 and 76 of contact 58, which are joined together by suitable means. One end of each contact finger is spaced apart and includes a contact pad constructed of electrically conductive material, such as contact pad 78 secured to first finger 74 and the contact pad 80 secured to the second finger 76 which are connected to the spaced ends of the first and second fingers 74 and 76. The first and second fingers 74 and 76 provide a leaf-type spring action which allows a movable contact, described hereafter, to forcibly separate the contact pads 78 and 80 and make good electrical connection thereto. The end of each stationary contact, such as end 82 of contact 60, opposite the contact pads is connected by suitable means, such as an electric lead, to a winding section of the electrical winding assembly of the distribution transformer 10.

In order to connect one of the winding sections to the electrical circuit, a movable contact assembly 84, as shown in FIGS. 2, 3 and 4, is provided. The movable contact assembly 84 is coaxially aligned about the axis 66 and includes a contact holder 86 which is secured to and rotated by the over-center toggle switch mechanism 34 described hereafter. A movable contact 88 is secured to the contact holder 86 and includes first and second contact fingers 90 and 92 which are adapted to electrically engage alternating stationary contacts 56, 58, 60, 62 and 64. Since the stationary contacts 56, 58, 60, 62 and 64 are arranged in first and second planes 68 and 70, the contact fingers 90 and 92 of the movable contact 84 are also arranged in two planes with the second contact finger 92 being switchable between the stationary contacts 56 and 60 arranged in the second or lower plane 70; while the first contact finger 90 alternately engages the stationary contacts 58 and 62 arranged in the first or upper plane 68 of the contact assembly 32. In addition, a portion 87 of the contact holder 86 forms a third contact finger which remains in continous contact with the stationary contact 64. During a closing operation, the movable contact forcibly separates the opposing contact pads of a particular stationary contact until the contact finger of the movable contact is disposed in registry between the opposing contact pads of the stationary contact thereby providing a secure electrical connection therebetween.

According to the preferred embodiment of this invention, the stationary contacts are spaced approximately 120° apart with the movable contact assembly 84 being switchable therebetween from a first to a second position. In either position, each of the first, second and third contact fingers 90, 92 and 87 of the movable contact assembly 84 electrically engage one of the stationary contacts, such as stationary contacts 56, 58 and 64, respectively in the second position shown in FIG. 4. Such a contact configuration provides the necessary connections in order to connect two winding sections in series or parallel per contact deck. Other configurations, including additional winding sections or different spacings between the stationary contacts, may also be used with the teachings of this invention.

Figure 5:
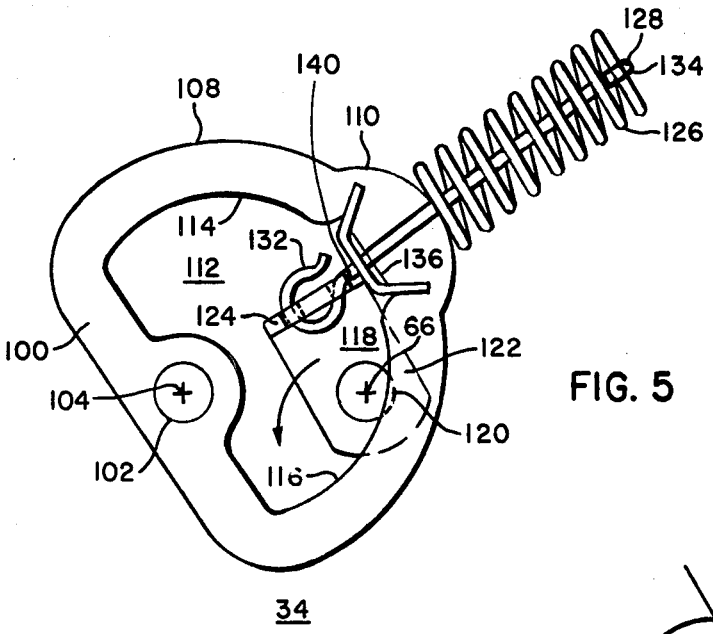
FIG. 5 is a sectional view, generally taken along line V—V in FIG. 2, showing a plan view of an over-center toggle switch constructed according to the teachings of this invention.

In certain applications, there is considerable frictional engagement between the movable and stationary contacts of the switch assembly or the contacts may become welded together during prolonged use which hinders or prevents a smooth opening action between individual movable and stationary contacts when the voltage rating of the distribution transformer is to be changed. In order to provide a positive opening or closing force sufficient to overcome the strong frictional engagement between the contacts or break any welds formed therebetween, a novel over-center toggle switch mechanism is provided. As shown in FIGS. 2, 3 and 5, the over-center toggle switch 34, associated with series-multiple switch 30, includes a first or drive member 100 which is journaled to a vertically extending operating shaft 102 rotatably mounted in a bracket 106 secured to the channel member 36. The drive member 100 and the operating shaft 102 rotate about a first vertically extending axis or centerline 104 in response to rotational movement imparted the operating shaft 102 by means described hereafter. The drive member 100 is constructed of a flat disc which has a substantially semicircular cross-sectional configuration; although other configurations may be utilized as well without departing from the teachings of this invention. As shown in FIG. 5, the configuration of the drive member 100 includes an outer peripheral circular portion 108 which has a radially extending lobe portion 110 centered thereon. In addition, drive member 100 includes an interior opening or slot 112 which defines, in part, first and second cam surfaces 114 and 116, the use of which will be described hereafter.

The over-center toggle switch 34 further includes a second or driven member journaled to an actuating shaft 120 which is coaxially aligned with a second vertically extending axis 66 disposed in parallel to the first axis 104. The driven member 118 includes a shoulder portion 122 secured to the actuating shaft 120 and a radially spaced vertically extending flange portion 124 which is disposed within the interior opening 112 of the drive member 100. The actuating shaft 120, which is rotatably mounted on the channel member 36, has its lower end connected to the contact holder 86 of the movable contact assembly 84 such that rotation of the driven member 118, actuating shaft 120 and contact holder 86 causes a switching of the movable contact 88 between adjoining stationary contacts of the contact assembly 32. As noted previously, sufficient force is required to overcome the strong frictional engagement or to break welds between the movable and stationary contacts during a switching operation. According to the teachings of this invention, a positive opening and closing force is provided by suitable biasing means, such as coil spring 126, which interacts with the rotation of the drive member 100 to impart a snap action switching movement to the driven member 118, the actuating shaft 120 and the movable contact assembly 84. The coil spring 126 has its first end disposed in registry with the lobe portion 110 of the drive member 100 and slideably movable thereon; with its second end extending radially outward therefrom. The spring 126 is held in position with respect to the drive member 100 by spring retainer rods 128 and 130 which are concentrically disposed within the coil spring 126. Each spring retainer rod, such as retainer rod 128 shown in FIG. 5, has a first end 132 formed in a hook-like configuration around the flange portion 124 of the driven member 118 to provide a rotatable connection between the spring retainer rod 128 and the flange portion 124 of the driven member 118. The second or opposite end 134 of the spring retainer rod 128 is bent around the outer end of the coil spring 126 to hold the spring 126 in position. A guide member 136 is secured to opening 112 in the drive member 100 opposite the lobe portion 110 and includes slots, not shown, through which the spring retainer rods 128 and 130 extend. The guide member 136 thus maintains the spring retainer rods 128 and 130 in position between the drive member 100 and the driven member 118.

Figure 6:
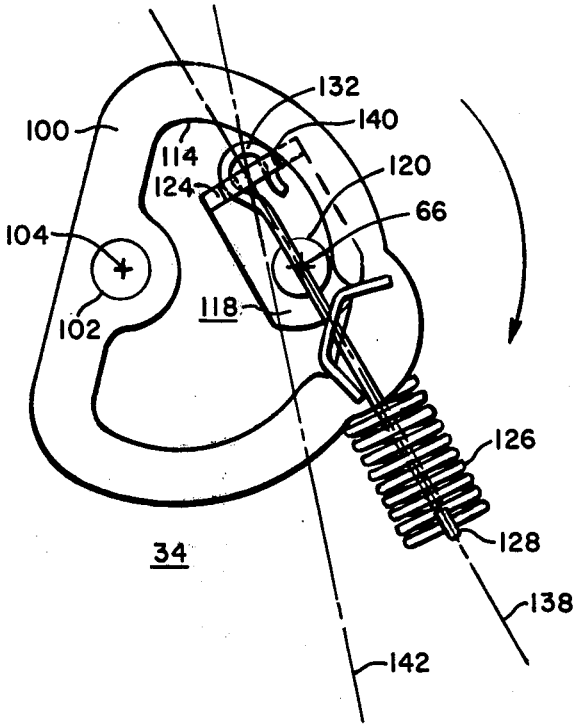
FIG. 6 is a sectional view, similar to FIG. 5, showing the position that the components of the over-center toggle switch occupy when rotated to the "dead-center" position.
Figure 7:
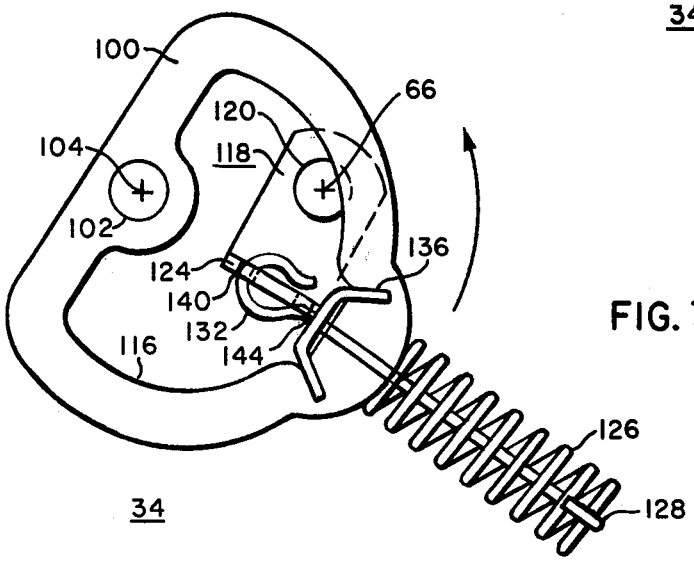
FIG. 7 is a sectional view, similar to FIG. 5, showing the position that the components of the over-center toggle switch occupy at the completion of the switching operation generally depicted in FIGS. 5 and 6.

The interaction of the drive member 100, the driven member 118 and the spring 126 to provide the aforementioned snap action movement of the movable contact assembly 84 will be more clearly understood by referring to FIGS. 5, 6 and 7 which depict the position that these components occupy during the various stages of a switching operation in which the movable contact assembly 84 is rotated 120° from electrical engagement with one of the stationary contacts, referred to as position No. 1, to electrical engagement with another stationary contact, referred to as position No. 2. In connecting the various winding sections of the transformer 10 in the desired series or parallel configuration, both of the first and second fingers 90 and 92 of the movable contact assembly 84 will make electrical connection to two stationary contacts with the portion 87 of the movable contact assembly 84 remaining continuously connected to stationary contact 64, shown in FIG. 4. However, for clarity, the following operation description will be described with respect to the movement of only one contact finger of the movable contact assembly 84; it being understood that the other contact finger simultaneously moves in an identical manner. Accordingly, FIG. 5 depicts the position the components of the over-center toggle switch 34 occupy when the first contact finger 90 of the movable contact assembly 84 is disposed in electrical engagement with stationary contact 58. In order to switch the contact finger 90 from stationary contact 58 to stationary contact 62 and thereby change the voltage rating of the distribution transformer 10, a clockwise rotational force is applied to the operating shaft 102 by suitable means, described hereafter, which results in a clockwise rotation of the drive member 100 about the first axis or centerline 104. During the clockwise rotation of the drive member 100 about axis 104, the guide 136 secured thereto forces the spring retainer rods 128 and 130 to rotate about their respective first or hook ends 132 which thereby cause the spring 126 to rotate in a clockwise direction on the lobe portion 110 of the drive member 100. During this rotation, the spring 126 is compressed between the outer end of the spring retainer rods 128 and 130 and the outer peripheral surface of the drive member 100 thereby storing compressive spring energy in the spring 126 until the drive member 100 has been rotated through a predetermined angle to a so-called "dead center" position, indicated by a centerline 138 in FIG. 6. The "dead center" position is formed by a line through the center of the flange 124 of the driven member 118, the centerline or axis 66 of the actuating shaft 120 and a centerline through the spring 126, which is the spring retainer rods 128 and 130. Thus, when the spring retainer rods 128 and 130 line up with the centerline 66 of the actuating shaft 120 and the center of the flange 124 of the driven member 118, the drive member is in the "dead center" position. Throughout the movement of the drive member 100 to the dead center position 138, the driven member 118 and the movable contact assembly 84 connected thereto remains stationary.

When the drive member 100 has reached the "dead center" position 138 shown in FIG. 6, the first cam surface 114 of the drive member 100 engages the first edge 140 of the flange portion 124 of the driven member 118. When the drive member 100 is rotated slightly past the "dead center" position 138, the first cam surface 114 imparts a counterclockwise rotation to the driven member 118 which is sufficient to overcome any strong frictional engagement between the movable and stationary contacts or to break any welds formed therebetween. Continued rotation of the drive member 100 to a position indicated by centerline 142 in FIG. 6 produces a so-called "toggle" action wherein the compressive energy stored in the spring 126 is released which provides a snap action rotation in a counterclockwise direction to the driven member 118 rotating it to the position depicted in FIG. 7 during which time the first contact finger 90 of the movable contact assembly 84 disengages from stationary contact 58 and moves into engagement with stationary contact 62.

In order to switch the first contact finger 90 of the movable contact assembly 84 from engagement with stationary contact 62 to stationary contact 58, a counterclockwise rotational movement is applied to the drive member 100 which causes the spring 126 and spring retainer rods 128 and 130 to move therewith and rotate about the first or hooked ends of the spring retainer rods 128 and 130. When the drive member 100 has been rotated to the "dead center" position, in which the centerline of the spring retainer rods 128 and 130 intersects the vertically extending axis 66, the second cam surface 116 on the drive member 100 will engage the second edge 144 of the flange portion 124 of the driven member 118 thereby imparting an initial clockwise rotation of the driven member 118 in a similar manner as that described above. Continued rotation of the drive member 100 past the "dead center" position results in the snap action toggle movement described above wherein the first contact finger 90 of the movable contact assembly 84 is switched from engagement from stationary contact 62 to engagement with stationary contact 58.

The combination of the toggle action and the initial camming of the driven member 118 immediately prior to toggle release provides snap action rotation of the movable contact assembly 84 and a quick break and make operation which insures solid electrical connection between the movable and stationary contacts. It will be apparent to one skilled in the art that the novel over-center toggle switch described above provides a fast opening and closing movement which results in a positive opening and closing action even if the contacts have considerable frictional engagement or are welded together. In addition, the over-center toggle switch described above produces an initial movement of the movable contacts immediately in advance of the toggle release which assists the over-center toggle switch in disengaging the movable contact from the stationary contacts. The novel over-center toggle switch described herein provides these features with a relatively small number of components thereby minimizing the manufacturing cost of the over-center toggle switch and resulting in a small compact switch which easily fits within existing distribution transformer tanks.

In multiple phase distribution type transformer applications, it is necessary to insure that the movable contacts in all phases of the transformer are connected to the same stationary contact of each contact set in order that the winding sections of each phase be connected in the same configuration. The novel over-center toggle switch described above may be advantageously utilized in multiple phase applications to insure that the movable contacts are connected to the same stationary contacts in each phase of the distribution transformer. There is shown in FIGS. 1, 2 and 3, an operating mechanism 25, comprising an operating rod 150 extending through the tank wall 12 of the distribution transformer 10 and connected to an operating handle 152, which is provided to exteriorly change the connections between the various winding sections in each phase of the distribution transformer 10. As shown more clearly in FIG. 2, a suitable connecting means 154 is provided to connect the individual over-center toggle switches 34, 34' and 34'', associated with each phase of the distribution transformer 10, to the operating mechanism 25. According to the preferred embodiment of this invention, the connecting means 154 includes individual pulleys 156, 158 and 160 which journaled to the operating shafts of the over-center toggle switches 34, 34' and 34'', respectively. A fourth pulley 162 is rotatably disposed between the mounting brackets 38 and journaled to a shaft 164 to which the operating rod 150 is coaxially connected by suitable means such that rotation of the operating rod 150 in one direction causes an identical rotation of the shaft 164 and the pulley 162. A cable 166 connects pulleys 156, 158, 160 and 162 such that rotation of the operating mechanism through a predetermined angle causes each over-center toggle switch 34, 34' and 34'' to operate independently in the manner described above and thereby switch the movable contact assemblies in each phase of the distribution transformer 10 between successive stationary contacts.

By utilizing individual over-center toggle switches in each phase of a multiphase distribution type transformer connected by a common connecting means to an exteriorly operable operating mechanism, the construction of multiple phase series-multiple switches is simplified since the stationary contacts in each phase need only be aligned with their respective movable contact instead of with the contact assemblies in adjoining phases of the distribution transformer as is required in typical prior art series-multiple switches utilizing one toggle switch mechanism to drive the movable contacts in each phase between successive stationary contacts. This novel construction not only insures that the winding sections in each phase of the distribution transformer are identically connected but also results in a smaller multiple phase series-multiple switch since the movement of the movable contacts in each phase is more accurate, thereby eliminating the need for making the stationary contacts oversized to allow for manufacturing tolerances or backlash in the construction of prior art type series-multiple switches. In addition, the possibility of misalignment of the stationary contacts between adjoining phases of the distribution transformer is reduced since the contact structures in each phase of the distribution transformer may be set up independent from adjoining contact structures.

Although pulley and cable means are utilized to interconnect the over-center toggle switches in each phase of the distribution transformer with the operating mechanism, other suitable connecting means, such as a rack and pinion gear drive, may be utilized without departing from the teachings of this invention. In addition, although the pulley and cable means may be utilized to operate an over-center toggle switch in single-phase applications, it is also contemplated that the operating shaft of the over-center toggle switch may be extended through the cover of the distribution transformer tank to directly rotate the drive member of the over-center toggle switch.

In summary, it will be obvious to one skilled in the art that there has been herein disclosed a new and improved over-center toggle switch suitable for use as a series-multiple switch in electrical distribution type transformers. The novel over-center toggle switch depicted herein provides quick breaking and making movement of the movable contact between successive stationary contacts along with initially rotating the movable contact immediately prior to the toggle action which overcomes any frictional engagement or welds between the movable and the stationary contacts thereby insuring the positive opening of the contacts. The over-center toggle switch provides these advantages with fewer components than prior art type over-center toggle switches which results in a lower cost and smaller overall size. The above-described over-center toggle switch may be advantageously used in multiple phase applications wherein individual over-center toggle switches are provided to operate the contact assemblies in each phase of the distribution transformer and are joined together by a common connecting means to an operating mechanism which insures that the winding sections in each phase of the distribution transformer are connected in the same configuration.

What is claimed is:

1. An over-center toggle switch comprising:

a drive member rotatable about a first axis;

means for rotating said drive member;

a rotatable actuating shaft defining a second axis parallel to said first axis;

a driven member secured to and rotatable with said actuating shaft; and biasing means connected between said drive member and said driven member for storing spring energy as said drive member is rotated through a predetermined angle whereon said spring energy is released imparting a snap action rotation to said driven member and said actuating shaft;

said drive member having an integral cam surface for engaging said driven member immediately prior to said release of said spring energy for imparting an initial rotation to said driven member and said actuating shaft.

2. The over-center toggle switch of claim 1 wherein the biasing means includes:

a coil spring having one end disposed in abutting relation with the drive member and a second end extending outward from said drive member; and spring retainer means, concentrically disposed within said spring and having one end secured to the driven member and another end connected to said second end of said spring, for forming a toggle connection between said drive and driven members such that rotation of said drive member through a predetermined angle compresses said spring.

3. The over-center toggle switch of claim 1 further including an electrical contact assembly having a plurality of stationary electrical contacts arranged in an arcuate pattern in a first plane perpendicularly around the second axis and a movable electrical contact joined to and rotatable with the actuating shaft and adapted to engage said stationary contacts.

4. The over-center toggle switch of claim 1 further including a plurality of electrical contact assemblies with individual over-center toggle switches associated therewith, respectively, and wherein the means for rotating the drive member of each of said toggle switches includes a rotatable operating shaft coaxially disposed along the first axis with said drive member journaled thereto, pulley means secured to said operating shaft and rotatable therewith, operating means rotatable between first and second positions and cable means connecting said pulley means of each of said over-center toggle switches with said operating means such that rotation of said operating means through a predetermined angle causes rotation of each of said pulleys and independent operation of each of said over-center toggle switches.

5. An over-center toggle switch comprising:

a drive member rotatable about a first axis, said drive member including an aperture, a portion of which defines an integral cam surface;

means for rotating said drive member;

a rotatable actuating shaft defining a second axis parallel to said first axis;

a driven member secured to and rotatable with said actuating shaft, said driven member including a shoulder portion connected to said actuating shaft and a flange portion extending therefrom, said flange portion of said driven member extending through said aperture in said drive member; and biasing means connected between said drive member and said driven member for storing spring energy as said drive member is rotated through a predetermined angle whereon said spring energy is released imparting a snap action rotation to said driven member and said actuating shaft, said biasing means including a coil spring, having one end disposed in abutting relation with said drive member and a second end extending outward from said drive member, and spring retainer means, concentrically disposed within said spring and having one end secured to said driven member and another end connected to said second end of said spring, for forming a toggle connection between said drive and driven members such that rotation of said drive member through a predetermined angle compresses said spring;

said integral cam surface of said drive member engaging said flange portion of said driven member immediately prior to said release of said spring energy for imparting an initial rotation to said driven member and said actuating shaft.

6. The over-center toggle switch of claim 5 wherein the spring retainer means includes a rod concentrically disposed within said spring and having one end thereof rotatably joined to the flange portion of the driven member and another end joined to the second end of said spring.

* * * * *